US005679986A

United States Patent [19]

Iversen

[11] Patent Number: 5,679,986

[45] Date of Patent: Oct. 21, 1997

[54] SYNCHRONIZATION OF SWITCHGEAR SWITCHING TO WAVEFORM INDICES

[76] Inventor: Arthur H. Iversen, 15315 Sobey Rd., Saratoga, Calif. 95070

[21] Appl. No.: 503,460

[22] Filed: Jul. 17, 1995

[51] Int. Cl.[6] ..... H01H 35/00

[52] U.S. Cl. ..... 307/130; 307/134; 307/137; 307/139; 307/125; 307/135

[58] Field of Search ..... 361/71, 72, 93, 361/18; 307/119, 122, 125, 135, 130, 134, 137, 139; 335/16, 195

[56] References Cited

U.S. PATENT DOCUMENTS

| | | | |
|---|---|---|---|
| 3,878,436 | 4/1975 | Bogel | 317/22 |
| 4,015,095 | 3/1977 | Bitsch et al. | 200/148 |
| 5,023,583 | 6/1991 | Bratkowski et al. | 335/195 |

*Primary Examiner*—William M. Shoop, Jr.
*Assistant Examiner*—Kim Lockett
*Attorney, Agent, or Firm*—Armstrong, Teasdale, Schlafly & Davis

[57] ABSTRACT

There is described method and apparatus to obtain synchronized switching of switchgear. A superposition of forces is used wherein the moving contacts of switchgear driven by a conventional operating mechanism has a secondary force, either opposing or aiding, superimposed upon the mechanism force under predetermined conditions to incrementally either slow down or speed up the moving contact. The computed secondary force is applied by a small servo-motor attached to the moving contact shaft. The energy of the secondary force is derived from a real time comparison of the measured position of the moving contact with its preprogrammed position in ROM at each predetermined point on the voltage or current waveform. From this comparison the required pulse energy is calculated and fed to the servo-motor which translates into the secondary force of appropriate duration thereby making the necessary incremental velocity correction. These corrections cause the moving contact to follow a preprogrammed time-distance curve such that there is a smooth time convergence of contact make and the zero voltage cross-over. The secondary force is much smaller than the mechanism force and serves only to correct for changes in moving contact travel time to closure caused by environmental effects such as temperature, pressure and age, as well as from waveform changes due to waveform distortion and frequency changes.

20 Claims, 3 Drawing Sheets

SYNCHRONIZATION OF SWITCHGEAR SWITCHING TO WAVEFORM INDICES

A prior U.S. Provisional application Ser. No. 60/000,529, was filed Jun. 26, 1995.

BACKGROUND OF THE INVENTION

In many electrical applications it is desirable to synchronize switching functions at a particular point, sometimes called index, on an electrical wave, either voltage or current. A prime application is in capacitor switching for power factor correction where capacitors are sequentially switched in as load variations, such as electric motors, degrade the power factor. This then serves to return the power factor to dose to unity. To minimize voltage transients during switching operations, it is desirable to cause the contacts to close when the voltage waveform passes through zero. Voltage transients due to capacitor switching are a major cause of computer malfunctions. For other requirements it may be desirable to break contacts at a voltage zero, or make or break contacts at a current zero. Alternatively, other points or indices on the voltage or current waveform may be selected for switchgear contact make or break operations. There is a need for low cost, robust zero voltage or current switching switchgear.

SUMMARY OF THE INVENTION

The present invention employs the superposition of forces wherein the moving contact of switchgear driven by a conventional operating mechanism has a secondary force, either opposing or aiding, superimposed upon the mechanism force under predetermined conditions to either slow down or speed up the moving contact such that the moving contact engages the fixed contact at a predetermined point or index on a voltage or current waveform, such as at zero voltage cross-over. The secondary force is much smaller than the mechanism force and serves to correct for changes in moving contact travel time to closure caused by temperature, pressure, age, as well as waveform index changes due to waveform distortion and frequency changes.

The present invention provides for the synchronization of moving electrical contacts and a point on a wave of an electrical signal including voltage or current.

The present invention provides for a robust, low cost zero voltage or current switching system.

DETAILED DESCRIPTION OF A PREFERRED EXEMPLARY EMBODIMENT

Figure 1:
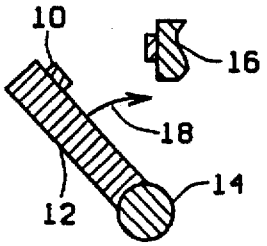
FIG. 1 is a partial cross section view of contacts illustrating the rotational motion of the moving contact toward the fixed contact.

Referring now to FIG. 1, shown is switchgear comprising a moving contact 10 mounted on arm 12 and attached to shaft 14. Fixed contact 16 is suitably positioned. An operating mechanism (not shown) causes moving contact 10 driven by force 18 to rotate in an arc towards fixed contact 16 about shaft 14. In general, the force imparted by the mechanism is large in order to cause a rapid engagement of contacts 10, 16. There are variations in the time interval between contact movement start to contact make caused by variations in mechanism force due to factors such as temperature, age, and if enclosed, pressure. The above factors make it difficult to obtain precise timing of contact movement in order to obtain a predetermined moment of contacts 10, 16 engagement. This is further complicated by variations in the electrical signal characteristics such as frequency, distortion and phase.

Figure 2:
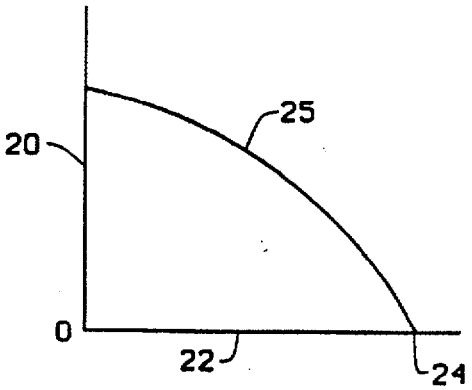
FIG. 2 is a plot of the time-distance path of the moving contact of FIG. 1.

Referring now to FIG. 2, shown is a plot 25 of the distance 20 between moving contact 10 and fixed contact 16 versus time 22 during contact 10 movement. The accelerating force 18, due to springs, solenoid, pneumatic etc. causes the angular velocity to build up thereby yielding the distance-time curve of FIG. 2 with contact make 24 between contacts 10, 16 being defined as distance zero, that is, contacts 10, 16 have engaged.

An objective of the present inventions is to obtain a predetermined time of contacts 10, 16 make 24 which is tied to a particular point or index on an electrical signal, such as zero voltage cross-over. This may be achieved by tracking the electrical signal in real time while simultaneously superimposing a second predetermined and variable accelerating or decelerating force to moving contact 10 such that the time-distance profile of FIG. 2 is met, that is, contacts 10, 16 make 24 coincides with the desired point on the electrical wave, such as zero voltage cross-over. The magnitude of the secondary force applied is proportional to the magnitude of the deviation of the path of contact 10 from the predetermined curve 25 of FIG. 2.

Figure 3:
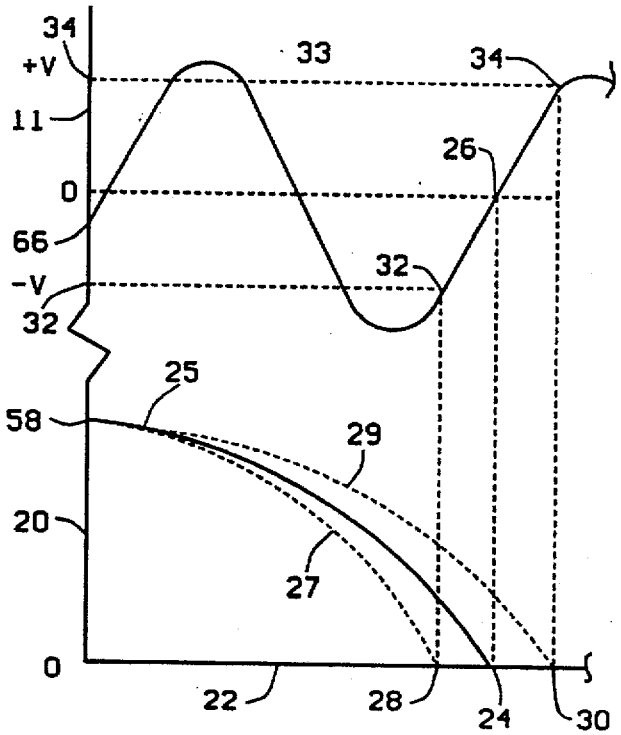
FIG. 3 is a plot of the time-distance path of the moving contact and a voltage waveform sharing the same time scale, and illustrating fixed and moving contact closure before, at and after a voltage zero.

Referring now to FIG. 3, shown is the time-distance curve of FIG. 2 incorporating an electrical signal 33, here shown as the voltage 11, with both using the same time scale to illustrate the desired performance where contacts 10, 16 make 24 coincide with zero voltage cross-over 26. However, because of the variables described before, contacts 10, 16 may engage before 28 or after 30 voltage zero 26 at indices 32 and 34 with the consequence of an instantaneous voltage 32 or 34 appearing across the capacitor bank. This voltage 32 or 34 causes a high inrush current which in turn can create high transient voltages and associated harmful harmonics in power systems. These harmonics can damage sensitive electronic systems such as adjustable speed drives and computers.

Figure 4:
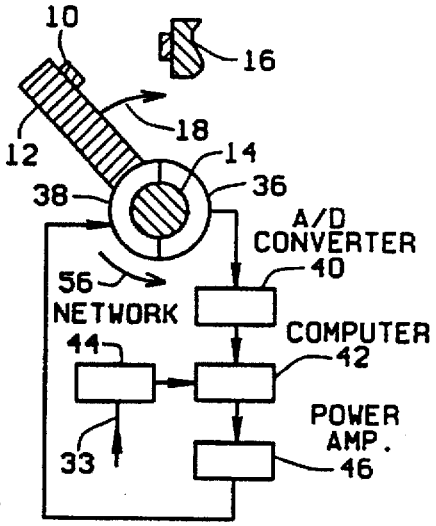
FIG. 4 is a block diagram of the components added to FIG. 1 to provide moving contact and waveform index synchronization.

Referring now to FIG. 4, shown is moving contact shaft 14 equipped with a rotary position transducer 36 which provides incremental or absolute measurement of position or angular displacement of moving contact 10. The transducer 36 may, for example, be inductively or capacitively coupled and generally comprise a spaced apart rotor and stator.

Precision to seconds of arc may be obtained in this manner. For linear movement of contacts, as is generally found in vacuum switchgear, a linear transducer may be employed. Synchronous resolvers may be employed. For moving contact 10 position measurements optical techniques may also be employed, for example, the use of rotary optical encoders which may incorporate fiber optics for voltage isolation.

The output of transducer 36 may be fed to suitable electronic processing systems such as an A to D converter 40 where the signal is processed. The output or the A to D converter 40 is then fed into a computer 42 which compares the indices of voltage waveform 33 with the position of contact 10 as provided by transducer 36. The voltage signal 33 is provided by, for example, resistor divider network 44. For a current signal, network 44 might use a suitable inductive loop. The computer then calculates a signal to be sent to power amplifier 46 which supplies a signal of suitable amplitude and duration to servo-motor 38 to generate force 56. Instead of digital technique, suitable analog methods may be applied.

Referring now to FIGS. 3 and 4, in comparing the voltage indices 26, 32, and 34 to the position of contact 10 as it moves toward closure with contact 16, computer 42 determines if closure will occur before 28 voltage zero 26, at 24 voltage zero 26 or after 30 voltage zero 26 in which case the secondary force must, respectively, slow down, do nothing or speed up in an appropriate manner, the motion of contact 10 to insure contacts 10, 16 closure at the voltage zero or other voltage or current index. The prime moving force 18, for example, spring, electromagnetic, e.g. solenoid, and pneumatic etc. to drive the moving contact 10 is provided by the switchgear operating mechanism (not shown). The secondary force 56 is imposed on the moving contact 10, either to speed it up or to slow it down such that the fixed contact 16 is engaged at substantially the same moment in time that either the voltage or current AC waveform crosses zero 26, or at some other predetermined point or index on the waveform. The secondary force serves to correct for any change in the time of flight of moving contact 10 as might be caused by temperature, pressure, age etc. on the mechanism, and to correct for waveform changes such as frequency, distortion and phase.

The superimposed secondary force 56 is determined in real time by periodically or continuously comparing the position of the moving contact 10 with indices of the electrical waveform 33 and determining if contacts 10, 16 engagement 24 will occur before or after the desired waveform zero 26. If contact is predicted before the waveform zero crossing 26, then the secondary force 56, which may be a suitable pulse, is applied opposite to the mechanism force in a suitably repetitive manner so as to slow down the moving contact 10 in a predetermined manner and thereby cause contacts 10, 16 engagement at zero crossing 26. Conversely, if contacts 10, 16 engagement is predicted after the waveform zero crossing 26, that is, contact 10 is moving too slowly, the secondary force 56 assists the mechanism force 18 and speeds up contact 10 to obtain engagement at zero crossover 26. In general, the secondary force 56 will be substantially less than the operating mechanism force 18 as its function is to fine tune the moment of contacts 10, 16 engagement 24 to coincide with a predetermined point on a wave, such as at zero crossing 26 of voltage 11.

For ease of implementation, a preferred method is to cause the moving contact 10 to always engage the fixed contact 16 either before 28 or after 30 the voltage or current zero 26 when only driven by the operating mechanism. In this manner the applied secondary force 56 always has the same direction, either slowing down or speeding up contact 10, thereby simplifying the needed electronics. The time differential between contacts 10, 16 make 28, 30 and waveform zero crossing 26 is set for the maximum expected over the life of the equipment as caused by, for example, temperature and associated pressure extremes, mechanism aging, frequency changes and waveform distortion. Thus, under the various environmental and electrical conditions and over time, contacts 10, 16 engagement when driven only by the operating mechanism, will always occur on one side of the waveform zero 26.

Referring again to FIG. 4, the method of applying the secondary force 56 may be through a variety of means, one of which may be servo motor 38 which has its rotor mounted on shaft 14 and the stationary stator mounted concentrically external to the rotor. Power to servo 38 from amplifier 46 may be, for example, by methods such as continuous wave, pulse width modulated (PWM), pulse repetition rate or pulse height modulation with the foregoing methods applied, either alone or in some suitable combination. For convenience, PWM operation will be described.

Figure 5:
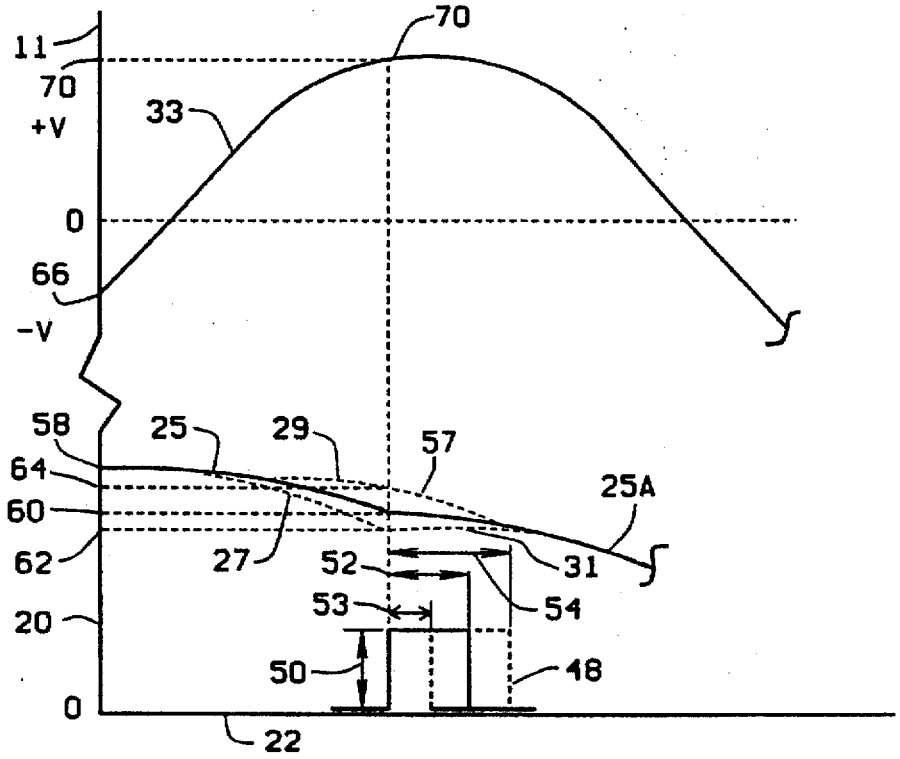
FIG. 5 is a plot of voltage waveform and moving contact distance against time on a common time scale to illustrate secondary force superposition to compensate the moving contact time-distance path for distorting effects such as temperature, aging, frequency change and waveform distortion.

Referring now to FIG. 5, shown, by way of example, is a preferred method for altering the motion of moving contact 10, as measured by the time-distance curve 25, into proper synchronism with waveform 33. Both waveform 33 and contact 10 stroke, that is, time-distance curve 25 are shown as segments and expanded in the horizontal time axis to better illustrate the effect of pulse 48 which provides the secondary force on the motion of contact 10. Index 66 of waveform 33 has been predetermined as being the appropriate timing to trigger the mechanism and start movement of contact 10 towards contact 16 such that closure 24 of contacts 10, 16 occurs at the predetermined time before the voltage zero when driven by the mechanism only. Thus, the secondary force 56 applied is retarding to insure zero cross over switching. Total time from start of contact 10 movement to contacts 10, 16 closure may require one or more cycles, for example, 30 to 50 milliseconds. The command to trigger at index 66, or other predetermined index, may be stored in ROM or by other suitable means.

Appropriate electronic storage means such as Read Only Memory (ROM) will have stored in it the indices of the electrical signal, for example, voltage waveform 33. For each of the waveform 33 indices, such as 70, there will be a corresponding position of contact 10, such as index 60 taken from predetermined composite curve 25. Computer 42 will also have suitable algorithms installed to compensate for signal waveform 33 changes such as frequency and distortion thereby insuring that contacts 10, 16 closure and zero voltage crossover or other index, smoothly converge. This may be accomplished by storing and analyzing, preferably in real time, one or more prior waveforms 33 and making the needed adjustments, for example, in index values, timing and pulse 48 width to correct for the shift in time 22 of the zero 26 voltage cross over.

In the full open circuit position, moving contact 10 is stationary at position index 58 and time zero. Upon command, the operating mechanism drives moving contact 10 along curve 25 which plots the distance to contact 16 engagement or make, on the vertical axis versus time on the horizontal axis. The mechanism energy transferred to moving contact 10 is, in general, never exactly the same with each operation of the switchgear due to temperature and pressure changes, aging and other effects. Thus, the acceleration and velocity of contact 10 and consequently time-distance curve 25 will vary each time the switchgear is operated. This variation must be compensated for if contacts 16, 10 are to engage at a voltage or current zero crossover, or other predetermined waveform index.

Referring again to FIG. 3 for illustration purposes, predetermined time-distance curve 25 is established to provide contacts 16, 10 engagement, when triggered at voltage index 66, prior to the waveform zero crossing when only driven by the mechanism with contacts 10, 16 engagement at 28. This then will require that the secondary force oppose the mechanism energy to slow down moving contact 10 in a predetermined manner such that contacts 16, 10 engagement occurs at waveform zero crossing. In addition to compensating for variable mechanism energy, further compensation may be required for line voltage frequency change or waveform distortion. Phase shift is automatically compensated for. Since the mechanism is triggered, by definition, at a point 66 on the wave 33 then both the wave and the point on the wave are phase shifted by precisely the same amount. The only effect is to advance or retard the moment in time that triggering 66 occurs, and it has no effect on the contact time-distance 25 curve relative to the waveform zero crossover 26.

Referring again to FIG. 5, a preprogrammed curve 25 of time versus contact 10 position is programmed in, for example, Read Only Memory (ROM). Curve 25 may be based on the measured time of flight characteristics of contact 10. Appropriate indices of voltage 11 waveform 33, such as 70, 71, 73 (FIG. 6) and which may be several hundred in number are also stored in ROM. Referring again to FIG. 5, curve 25 represents the preferred time-distance path of contact 10 such that when a predetermined number of pulses 48 of width 52 are applied to servo-motor 38 to create a negative secondary force 56 to slow down contact 10, contacts 16, 10 engage at zero voltage 26. The energy of pulse 48, that is the servo motor operating voltage times the current 50 and pulse width 52, 53 or 54, drives servo motor 38 and causes an incremental decrease in contact 10 velocity.

Should the mechanism force be too high with consequent excess contact 10 velocity resulting in contact 10 index being 62 at voltage index 70 and with contact 10 following curve 27 instead of curve 25, pulse 48 is widened 54 by computer 42 to provide more servo 38 energy to further slow down contact 10. The result is that contact 10 then follows curve 31 causing convergence with predetermined curve 25A. Conversely, if the mechanism energy is low, resulting in contact 10 index being 64 at voltage index 70 and with contact 10 following curve 29 instead of curve 25, pulse 48 is narrowed 53 such that servo 38 supplies less opposing energy to contact 10 motion thereby reducing the contact 10 velocity less than standard pulse 52. The result is that contact 10 then follows curve 57 causing convergence with preprogrammed curve 25A. These steps are then repeated at each voltage 11 index and which may be several hundred in number, thereby providing a smooth convergence of contacts 10, 16 closure and zero 26 voltage cross over.

Figure 6:
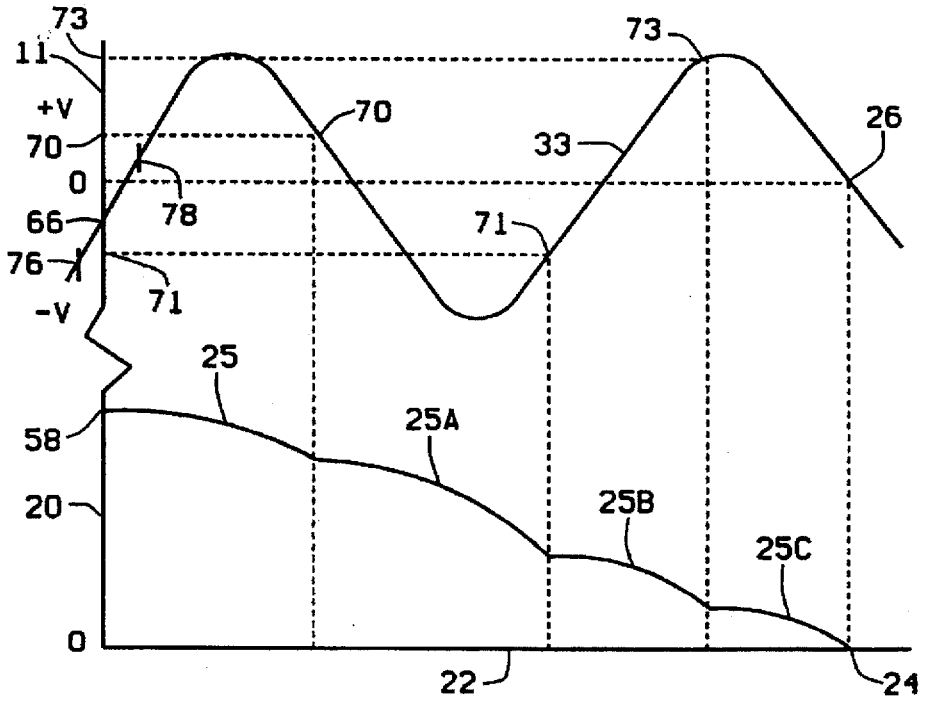
FIG. 6 is FIG. 5 illustrating multiple time-distance path corrections for the moving contact to provide synchronism between contact closure and zero voltage cross-over.

Pulse 48 height 50 is substantially constant for voltage and current for PWM applications. Computer 42 supplies pulse 48 of suitable width 52, 53, 54 to power amplifier 46 which then feeds the amplified signal of suitable power level to servo-motor 38. The power of pulse 48 or series of pulses are converted to a rotational force 56 of appropriate duration, in this example opposing the motion of contact 10 such that contact 10 follows predetermined curve segments 25A, 25B, 25C as shown in FIG. 6. Alternatively, a continuous wave input to servo-motor 36 may be employed with the wave height, that is, amplitude modulation, similar to pulse 48 height 50, being determined by the need to relatively slow down or speed up contact 10 to fit the predetermined time-distance curve segments 25A, 25B, 25C etc. as described above. The time intervals between computer 42 wave height 50 adjustments correspond, as before, to the time intervals between voltage waveform indices 70, 71, 73 etc. As a further embodiment, the above continuous wave may be chopped into pulses of convenient width, such as 52, 53, and 54.

Referring again to FIG. 5, shown is the time 22-distance 20 curve of contact 10 incorporating the effect of the secondary retarding force 56 of multiple pulses 48 such that contacts 10, 16 closure 24 substantially coincides with the zero 26 cross-over of voltage waveform 33. Composite curve 25, 25A, 25B, 25C, (FIG. 6) shows the distance of moving contact 10 from fixed contact 16 versus time, with the same time scale also shown for waveform 33. Referring again to FIG. 5, when, for example, index 70 of waveform 33 is reached, the position index 60, 62 or 64 of contact 10 is read from position transducer 36. At the same time the predetermined position of contact 10 is taken from ROM as being 60 at voltage index 70. If the position reading is 60 then the computer 42 generates the standard secondary retarding 56 pulse 48 width 52 which is applied to servo-motor 38 from power amplifier 46. If contact 10 position reading is 62 then contact 10 is traveling too fast and pulse 48 width is increased to 54 to supply the needed greater retarding energy 56 to change curve 27 to curve 31 thereby bringing contact 10 movement more closely in line with predetermined curve segment 25A. Conversely, if contact 10 position readout is 64 at voltage index 70 then contact 10 is moving too slowly. In these circumstances pulse 48 width is narrowed to 53 thereby providing a lesser slowing energy 56 to contact 10 than standard retarding pulse width 52. This permits contact 10 to retain a greater velocity and cause curve 29 to change to curve 57 and thus into closer conformity to standard curve segment 25A.

Referring now to FIG. 6, the contact 10 path 25 correction described for FIG. 5 is now applied to multiple arc segments 25A, 25B and 25C corresponding to voltage indices 70, 71 and 73. As described in FIG. 5 for voltage index 70 where pulse 48 of appropriate width 52, 53 and 54 was employed to bring the path of contact 10 into general conformity to preprogrammed path 25A, the same retarding force 56 criteria and operations are performed at voltage indices 71 and 73 to maintain contact 10 path in general conformity to preprogrammed time-distance curves 25B and 25C in order to insure zero cross-over contact make. With contact 10 travel time from start of motion 58 by the operating mechanism to engagement 24 being, for example, 50 milliseconds, that is, about three cycles, then at a 200 microsecond sampling interval, 5 kHz, about 250 voltage indices, such as 70, 71, 73 will be stored in ROM. Thus, 250 position measurements of contact 10 will be made from position transducer 36 between start of movement at index 58 to contact 16 engagement. At each of the 250 indices such as 70, 71, 73 servo motor 38 applies, for example, a pulse 48 of suitable width 52, 53, 54 to bring contact 10 path into general conformity with the 250 programmed curve segments such as 25A, 25B and 25C. This large number, here 250, of contact 10 path corrections provides for a relatively smooth convergence of contacts 10, 16 engagements 24 and zero 26 voltage cross-over.

Referring again to FIG. 6, to minimize the secondary force 56 that is required, a first order correction may be applied to the waveform index 66 where triggering of the mechanism takes place. In a particular set of circumstances, should the sum total of corrections required for the contact time-distance curve 25 exceed a predetermined value, that is, when the required secondary force exceeds a predetermined value due to, for example, excess temperature changes, then the mechanism trigger index 66 is appropriately changed by the computer 42 to provide a correction that returns the needed secondary force 56 to within prescribed limits. If, for example, the calculated secondary energy, that is, the integrated secondary force 56 and duration over the path of contact travel, is greater than a predetermined maximum, then the contact is traveling too slow. This may be corrected by advancing the waveform trigger index to index 78 which shortens the time on the moving contact time-distance path to zero voltage crossover, and so now brings the secondary energy requirements to within predetermined limits. In like manner, if the required secondary energy is below a specified threshold, then the contact is moving too fast. Then the waveform trigger index is retarded by the computer to index 76 thereby lengthening the time of the contact time-distance path 25. This causes the secondary energy to be increased to within the prescribed limits. With the first order time-distance path corrections possible by altering the waveform 33 trigger indices, such as 76, 78 the necessary secondary force may be kept quite small. Compared to the precision control of the secondary force 56, adjusting the mechanism trigger index is relatively a coarse adjustment. It adds little to the system costs. It serves primarily to compensate for unusual deviation caused by extreme conditions and can also serve to reduce the maximum needed secondary force.

For illustration purposes, FIG. 5 shows a single pulse 48 generated for each waveform 33 index, such as 70. However, to reduce the size and cost of power amplifier 46, a number of pulses 48 may be employed for each of the indices, such as 70, 71, 73, the requirement being that the sum total of energy of all pulses 48 delivered to servo motor 36 is that required to cause contact 10 to substantially follow the predetermined time-distance path of, for example, curve segment 25A. The same requirement applies to curve segments 25B, 25C and all succeeding curve segments, such as the 250 described above. Though pulse 48 is shown as a square wave, any suitable waveform may be employed. The foregoing describes a circuit make condition. In a manner similar to that described above, a voltage or current zero cross-over circuit beak may be obtained.

When using the point on wave, e.g. zero voltage, switching in power factor correction systems employing multiple capacitors, it is desirable to match the capacitor values to the immediate load in order to maintain near unity power factor, and to achieve this over a wide load range. The load varies during the day with for example, motors being turned on and off, and the phase angle between voltage and current changes, that is, the power factor, will change accordingly.

Figure 7:
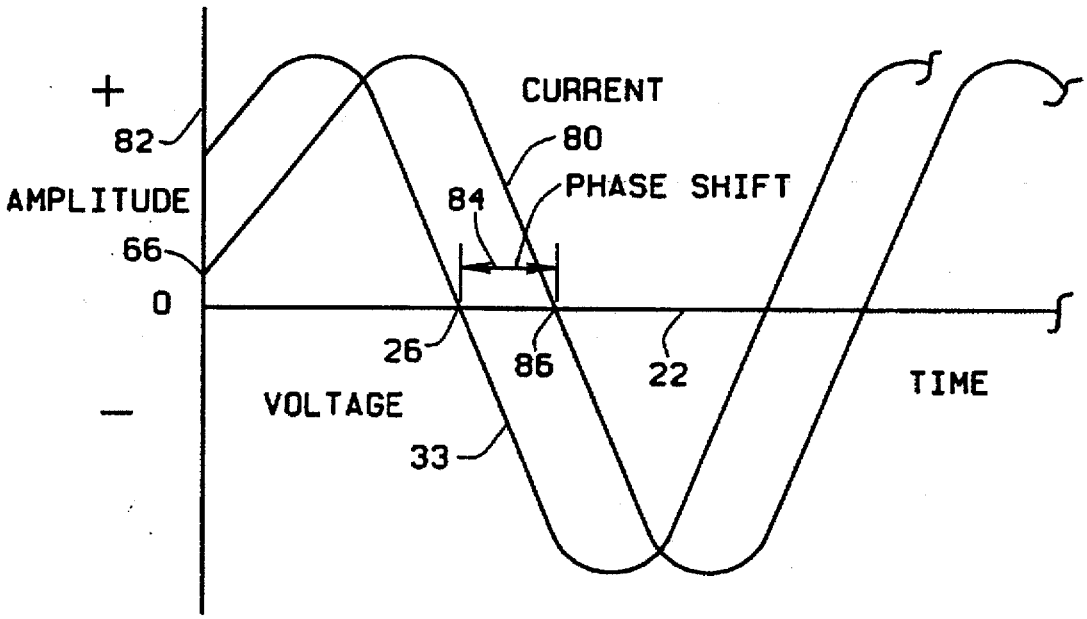
FIG. 7 illustrates a voltage waveform and a current waveform out of phase with each other resulting in a power factor of less than unity.

To monitor the phase angle between voltage and current, the voltage divider network 44 of FIG. 4 is also equipped with a current loop. Referring now to FIG. 7, to measure the phase angle 84, only voltage 26 and current 86 zeros need be detected and the time between them measured. Look-up tables in ROM may be used, with any necessary computer 42 corrections for frequency change etc., to then have the computer convert the time to a phase angle 84. Further look-up tables in ROM are then consulted by the computer 42 to determine the necessary capacitor kVAR that must be added or subtracted, depending on a leading or lagging phase angle 84. The appropriate zero voltage crossover switches and associated capacitors (not shown) are then commanded by the computer 42 to switch in or out to bring the phase angle 84 as dose to zero as possible. This process is repeated each time the voltage-current phase angle 84 exceeds a predetermined value. The computer 42 is provided with suitable algorithms to filter out spurious zeros as might occur when high levels of harmonics are present. For example, line frequencies generally change very little. Thus, any zero outside a specified time window is rejected.

As described above, incremental corrections to the capacitor kVAR connected to the power line are made on an as needed basis as the load changes during the day or night, thereby maintaining near unity power factor. For example, three capacitors of different values provide 8 combinations of kVAR for 12½% increments. By employing switching at load increment midpoints, unity power factor may be approached to within about 6% of unity power factor respectively That is, unity power factor is about mid way in the last kVAR switched in with the phase angle being either leading or lagging.

With symmetrical, i.e. no DC offset, current 80 and voltage 33 waveforms, the time intervals between zero crossovers is equal. However, with asymmetrical waveforms, the DC offset causes unequal times between adjacent zeros. This may also occur with distorted waveforms. Asymmetrical waveforms may be measured by having the computer 42 take the ratio of the waveform 80, 33 peaks of amplitude 82 of the positive and negative waves. Absolute values are generally not required. A method such as look up tables in ROM can translate the ratio of peaks into the appropriate voltage 26 or current 86 zero time intervals or other waveform characteristic. Any deviations are likely to be caused by waveform distortion. From this data appropriate corrections to the secondary force 56 and/or to the trigger index 66 may be made by the computer 42 to insure that contact make 24 occurs at a voltage 26 or current 86 zero, or other point on a wave.

The switching in or out of capacitors to bring the leading or lagging phase angle 84 between voltage and current as close to zero as practical, i.e. unity power factor, may be done in an automatic incremental step process. That is, capacitors are switched in small increments, progressively reducing the phase angle 84 until the phase angle between voltage and current is at the closest to zero that the smallest kVAR step can provide. Below this predetermined limit, the switching sequence stops. This simple method can provide an inexpensive automatic technique in real time, in effect chasing the phase angle and always maintaining it near zero.

I claim:

1. Apparatus for controlling a switch including a movable contact and a substantially stationary contact, the movable contact having a first position in which the movable contact is in a circuit making position with the substantially stationary contact and a second position in which the movable contact is not in a circuit making position with the substantially stationary contact, said apparatus comprising:

a movable contact position sensing unit for determining a position of the movable contact as the movable contact moves toward the substantially stationary contact; and a velocity control unit coupled to said movable contact position sensing unit and configured for affecting a velocity at which the movable contact moves toward the substantially stationary contact so that the movable contact contacts the substantially stationary contact, and is in the first position, in accordance with at least one predetermined condition.

2. Apparatus in accordance with claim 1 wherein said movable contact position sensing unit comprises a linear transducer.

3. Apparatus in accordance with claim 1 wherein said movable contact position sensing unit comprises an angular transducer.

4. Apparatus in accordance with claim 1 wherein said movable contact position sensing unit comprises an encoder.

5. Apparatus in accordance with claim 1 wherein said movable contact position sensing unit is configured to determine a position of the movable contact relative to the substantially stationary contact as the movable contact moves toward the substantially stationary contact.

6. Apparatus in accordance with claim 1 wherein said velocity control unit comprises a processing unit for receiving an output signal from said movable contact position sensing unit and determines whether to affect the velocity of the movable contact using said movable contact position sensing unit output signal.

7. Apparatus in accordance with claim 6 wherein said processing unit is configured to:

compare an actual position of the movable contact to a predetermined position, and based on a difference between the actual position and predetermined position, determine whether to affect the velocity of the movable contact.

8. Apparatus in accordance with claim 6 wherein said velocity control unit comprises a servo motor coupled to the movable contact.

9. Apparatus in accordance with claim 1 wherein said predetermined condition is that the movable contact be in a circuit making position when a waveform is within a predefined range.

10. Apparatus in accordance with claim 9 wherein said waveform is a current waveform and said predefined range includes a zero crossing of said waveform.

11. Apparatus in accordance with claim 9 wherein said waveform is a voltage waveform and said predefined range includes a zero crossing of said waveform.

12. Apparatus in accordance with claim 1 wherein said velocity control unit comprises a memory unit, and said predetermined condition is that the movable contact be in a circuit making position when a waveform is within a predefined range, said memory unit having stored therein data representative of predetermined movable contact positions corresponding to respective waveform indices.

13. Apparatus in accordance with claim 12 wherein said velocity control unit further comprises a processing unit for receiving an output signal from said movable contact position sensing unit and determines whether to affect the velocity of the movable contact using said movable contact position sensing unit output signal, said processing unit configured to:

compare an actual position of the movable contact to data stored in said memory unit, and based on a difference between the actual position and the compared data, determine whether to affect the velocity of the movable contact.

14. A zero crossing switch control unit for controlling a switch including a movable contact and a substantially stationary contact so that the movable contact makes an electric circuit with the substantially stationary contact within a predetermined range including a zero crossing of a monitored, substantially sinusoidal signal, said zero crossing switch control unit comprising:

a movable contact position sensing unit for determining a position of the movable contact as the movable contact moves toward the substantially stationary contact; and a velocity control unit coupled to said movable contact position sensing unit and configured for affecting a velocity at which the movable contact moves toward the stationary contact so that the movable contact is in the circuit making position in the predetermined range, said velocity control unit comprising a processing unit for receiving an output signal from said movable contact position sensing unit and configured to:

compare an actual position of the movable contact to a predetermined position, and based on a difference between the actual position and predetermined position, determine whether to affect the velocity of the movable contact.

15. A switch control unit in accordance with claim 14 wherein the movable contact moves linearly relative to the substantially stationary contact, and said movable contact position sensing unit comprises a linear transducer.

16. A switch control unit in accordance with claim 14 wherein the movable contact moves angularly relative to the substantially stationary contact, and said movable contact position sensing unit comprises an angular transducer.

17. A switch control unit in accordance with claim 14 wherein said velocity control unit comprises a memory unit, and said predetermined condition is that the movable contact be in a circuit making position when a waveform is within a predefined range, said memory unit having stored therein data representative of a preferred movable contact position at different indices along said waveform.

18. A method of controlling the velocity at which a movable contact moves toward a substantially stationary contact and into a circuit making position in which the movable contact is in a circuit making position with the substantially stationary contact, said method comprising the steps of:

determining a position of the movable contact as the movable contact moves toward the substantially stationary contact; and affecting a velocity at which the movable contact moves toward the stationary contact so that the movable contact contacts the substantially stationary contact and is in the circuit making position in accordance with at least one predetermined condition.

19. A method in accordance with claim 18 wherein determining a position of the movable contact as the movable contact moves toward the substantially stationary contact comprises the step of determining a position of the movable contact relative to the substantially stationary contact.

20. A method in accordance with claim 18 wherein affecting a velocity at which the movable contact moves toward the stationary contact comprises the steps of:

comparing an actual position of the movable contact to a predetermined position, and based on a difference between the actual position and predetermined position, determining whether to affect the velocity of the movable contact.

* * * * *